US006437763B1

(12) United States Patent
Migny et al.

(10) Patent No.: US 6,437,763 B1
(45) Date of Patent: Aug. 20, 2002

(54) PANEL FOR DISPLAYING MESSAGES BY LIGHT SPOTS

(75) Inventors: Philippe Migny, Saint Cyr S/Loire; Pierre Passet, Tours, both of (FR)

(73) Assignee: Securite et Signalisation, Chambourg-sur-Indre (FR)

( * ) Notice: Subject to any disclaimer, the term of this patent is extended or adjusted under 35 U.S.C. 154(b) by 0 days.

(21) Appl. No.: 09/476,200

(22) Filed: Jan. 3, 2000

(30) Foreign Application Priority Data

Jan. 4, 1999 (FR) ..... 99 00009

(51) Int. Cl.[7] ..... G09G 3/32

(52) U.S. Cl. ..... 345/82; 349/62

(58) Field of Search ..... 345/82, 83, 39, 345/44, 46, 84, 102, 905; 349/58, 61, 62, 69, 70; 362/257, 268, 310; 313/500, 510, 513

(56) References Cited

U.S. PATENT DOCUMENTS 4,603,496 A * 8/1986 Latz et al.
4,935,665 A * 6/1990 Murata
5,760,754 A * 6/1998 Amero, Jr. et al. ..... 345/82
6,296,376 B1 * 10/2001 Kondo et al.

* cited by examiner

*Primary Examiner*—Regina Liang
(74) *Attorney, Agent, or Firm*—Cohen, Pontani, Lieberman & Pavane

(57) ABSTRACT

The invention relates to a message display panel comprising a plurality of light emitting elements arranged in matrix form on a display surface. Each emitter element is constituted by a first end face of an oblong body made of transparent material which comprises on its second end face at least one cylindrical housing in which a light emitting source is placed. The housing comprises a bottom 18 having a convex internal surface which concentrates the light flux received towards the first end face. The body is square in section and preferably comprises three housings each receiving an electroluminescent diode.

8 Claims, 3 Drawing Sheets

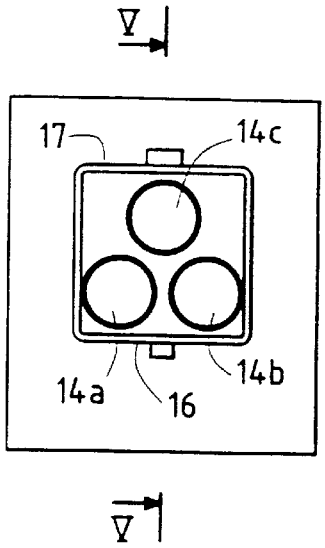
FIG.6
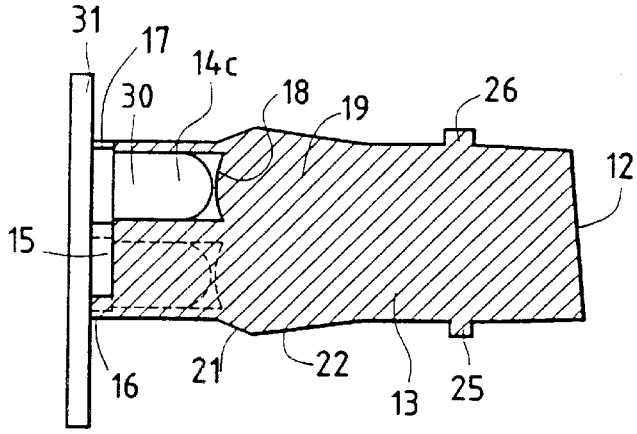
FIG.5
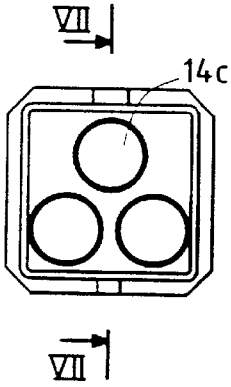
FIG.8
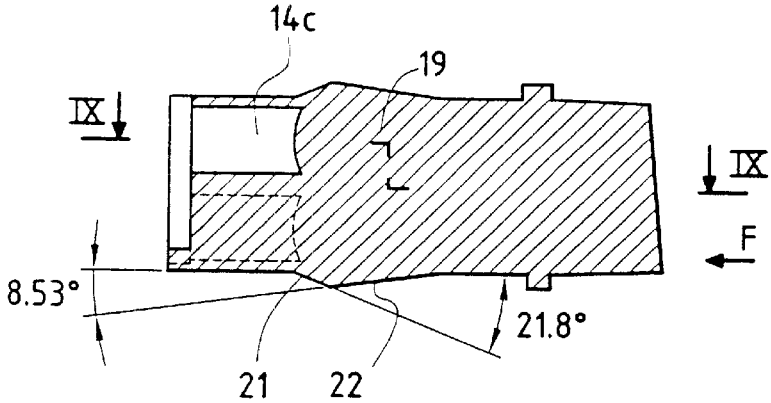
FIG.7
FIG.9
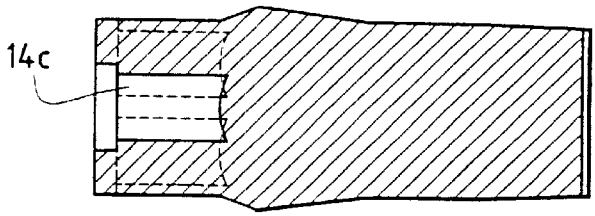

PANEL FOR DISPLAYING MESSAGES BY LIGHT SPOTS

FIELD OF THE INVENTION

The present invention relates to a panel for displaying messages, of the type comprising a plurality of light emitting elements arranged in matrix form on a display surface.

It relates more particularly to a panel for displaying variable messages, used for road or motorway signs.

BACKGROUND OF THE INVENTION

Such messages must be able to be read by the road users from afar. The light emitting elements must therefore emit a light beam of high intensity in a direction opposing the axis of the traffic. In addition, the distances between two consecutive emitting elements must be relatively small, for the user to have the impression of seeing a continuous image, although this is made in the form of light spots.

Light emitters generally comprise lamps or electroluminescent diodes which emit a light beam having an apex angle clearly greater than the angle of the beam strictly necessary for the sign.

In order to obtain the desired light intensity, these light emitters consume clearly more energy than the useful quantity of light, which brings about problems of cooling the panel supporting the light emitters.

In order to increase the output of the light emitters, parabolic reflectors may be used, which reflect the light beam emitted by the light emitter in a narrower pencil, the light emitter being placed at the focus of the reflector. However, the presence of these reflectors notably increases the distance between two light emitters, which is detrimental to the legibility of the message.

It is an object of the present invention to overcome these drawbacks.

SUMMARY OF THE INVENTION

The invention achieves this object in that each light emitting element is constituted by a first end face of an oblong body made of a transparent material and which comprises on its second end face at least one cylindrical housing in which a light emitting source is placed, said housing presenting a bottom having a convex internal surface so as to concentrate the light flow emitted by said source and illuminating said bottom, into a narrower beam directed towards the first end face, said bodies being disposed in rows and columns and separated from one another.

The light emitting source is advantageously an electroluminescent diode.

The body preferably presents a quadrangular section along a transverse plane.

To allow mixing of the lights emitted by a plurality of light sources emitting in the same ranges of colors or different ranges, the body comprises, on its second end face, three separate cylindrical housings each receiving a light emitting source. Two housings are provided laterally near an edge of the second end face and the third housing is provided in the median zone of the opposite edge.

In order to improve the light output, the body presents an annular swelling defined on each lateral face of the body by two planar surfaces which intersect in a transverse plane lying between the bottom and the first end face, said surfaces being intended to reflect at least a part of the light rays illuminating the cylindrical wall of a housing towards the first end face.

In order to allow fixation of the body in an orifice of a support, the body presents studs near its first end face.

BRIEF DESCRIPTION OF THE DRAWINGS

The invention will be more readily understood on reading the following description with reference to the accompanying drawings, in which:

FIG. 5 is a section along a vertical plane represented by line V—V of FIG. 6 of a light emitting assembly and associated emitter sources.

FIG. 6 is a front view of the light emitting assembly of FIG. 5.

FIG. 7 is a section along a vertical plane of the light guiding body, this section being taken along line VII—VII of FIG. 8.

FIG. 8 is a front view, in the direction of arrow F of FIG. 7, of the light guiding body, and FIG. 9 is a section of the light guiding body along line IX—IX of FIG. 7.

DESCRIPTION OF PREFERRED EMBODIMENT

Figure 1:
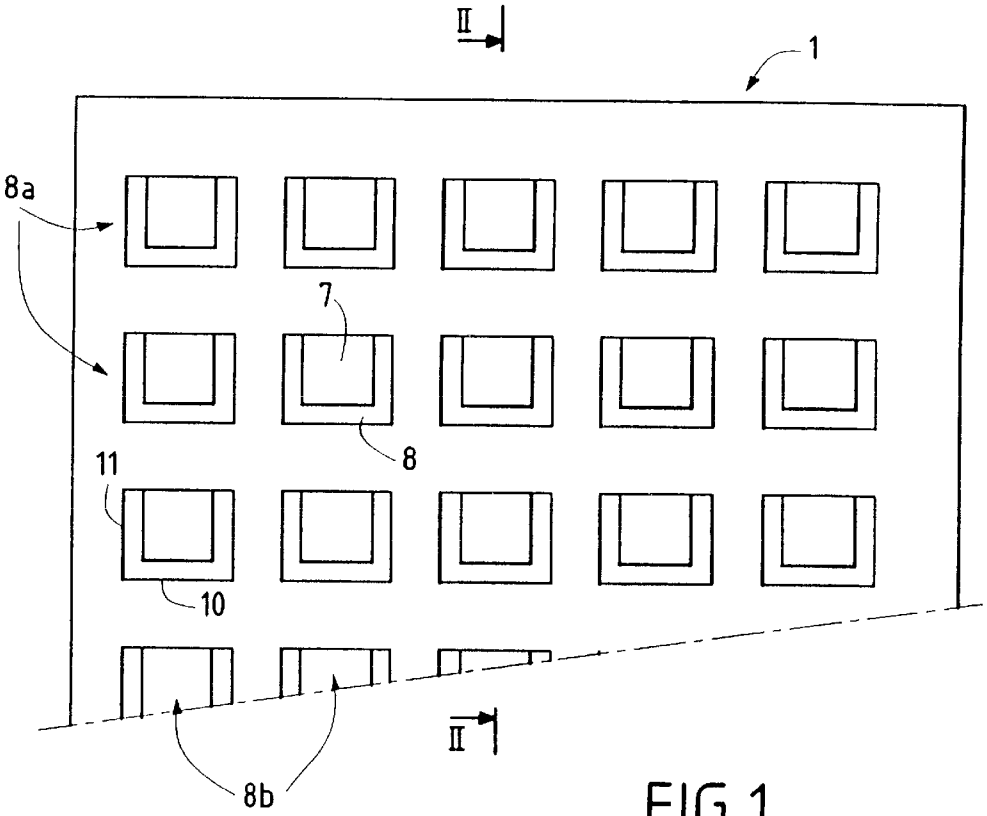
FIG. 1 is a front view of part of a road sign display panel according to the present invention.
Figure 2:
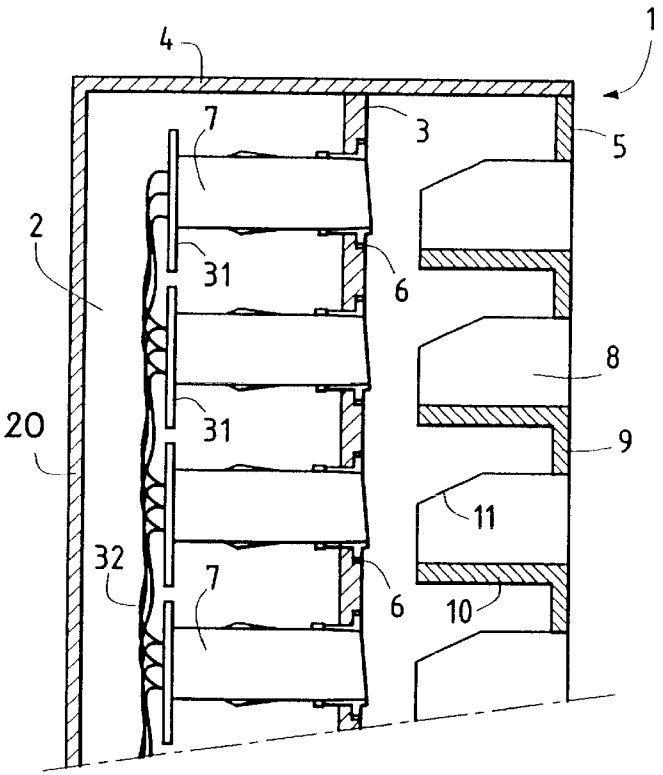
FIG. 2 is a vertical section along line II—II of FIG. 1, of the same panel.
Figure 3:
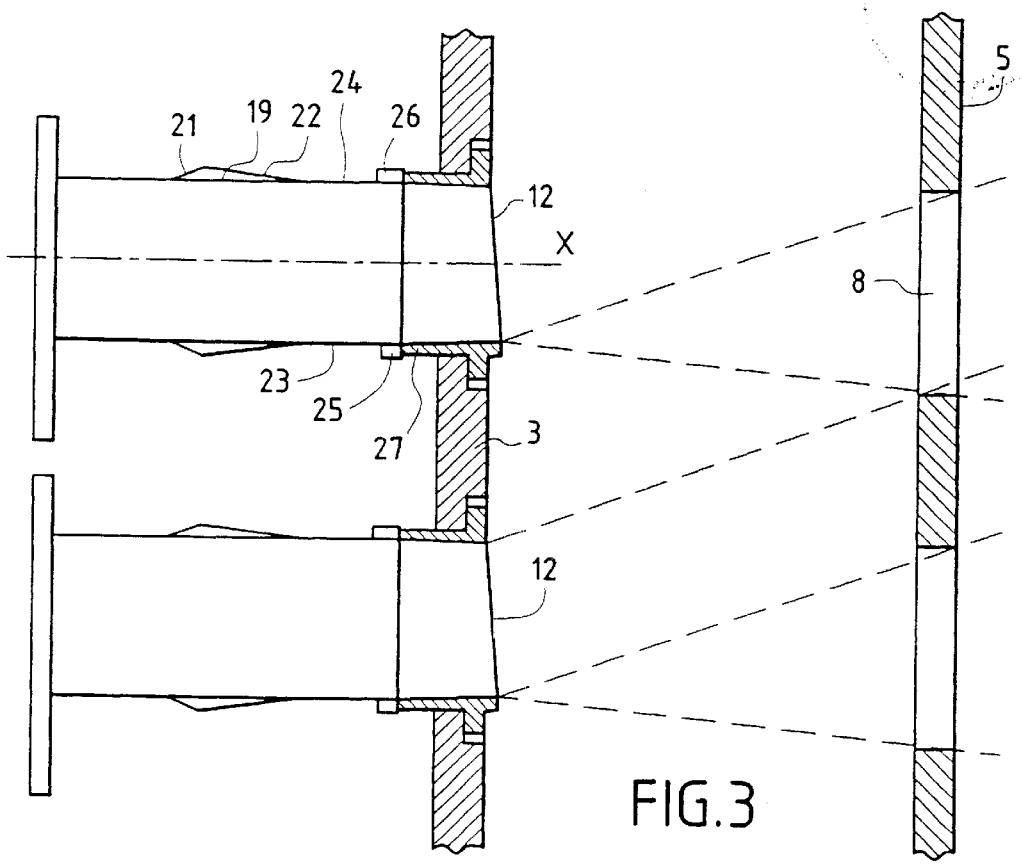
FIG. 3 is a section on a larger scale of the panel of FIG. 1 in a vertical plane.
Figure 4:
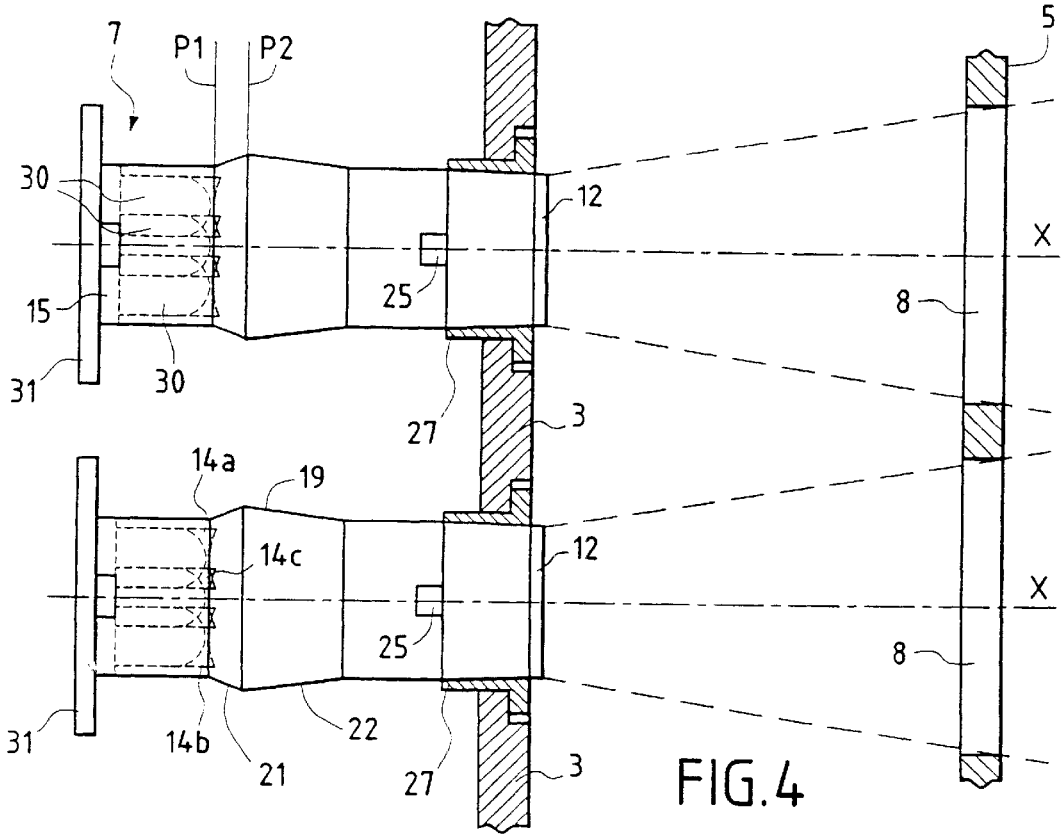
FIG. 4 is a section along a horizontal plane of the panel of FIG. 1.

Referring now to the drawings, FIGS. 1 and 2 show a display panel 1 comprising a box 2 of parallelepipedic shape, defined by a front wall 3, side walls 4, and a rear wall 20 which is generally mounted to pivot about a lateral axis in order to constitute a door providing access to the interior of the box 2. The side walls 3 extend towards the front of the box 2 and support a screen 5.

In the front wall 3 there are arranged a plurality of openings 6, square or rectangular in shape, in which are disposed the illuminating ends of light emitting elements 7. The openings 6 are disposed in rows 8*a* and in columns 8*b* regularly spaced from one another so as to constitute a matrix.

The screen 5 comprises, opposite openings 6, orifices 8 of rectangular shape, defined on the inner face 9 of the screen 5 by lower walls 10 and side walls 11 which extend towards the front wall 3. The orifices 8 present larger dimensions than those of the openings 6, and their axes are offset downwardly with respect to the axes of the openings 6. These dimensions are calculated so that the light flow emitted by each light emitting element 7 passes through the corresponding orifice 8. The purpose of the screen 5 and of its walls 10 and 11 is to prevent the sun's rays from illuminating the light emitting elements 7.

According to the present invention, each light emitting element 7 is formed by the substantially planar, first end face 12 of an oblong body 13, of axis X, made of a transparent material, for example PMMA, which presents a square section along transverse planes perpendicular to axis X.

Three cylindrical housings 14*a*, 14*b* and 14*c* open out on the second end face 15 of the oblong body 13. Two of these housings 14*a* and 14*b* open out laterally near the lower edge 16 of the second end face 15, while the third housing 14*c* opens out in the median zone of the upper edge 17 of this second end face. Each housing comprises a bottom 18 which presents a convex inner surface of revolution about an axis parallel to axis X.

The bottoms 18 lie in a transverse plane P, and, as is clearly shown in the FIGS., the body 13 comprises an annular swelling 19 defined on each side face of the body 13 by two planar surfaces 21 and 22 which intersect in a transverse plane P2 lying between the plane P1 and the first end face 12 of the body 13.

The oblong body 13 further comprises, on its lower (23) and upper (24) faces near the first end face 12, studs 25 and 26 which come into abutment on the inner face of a sleeve 27 defining an opening 6 in the front wall 3 of the box 2, and serving as support for said body 13.

The first end face 12 is planar and disposed in a plane making an angle of about 5° with the plane perpendicular to axis X. The bodies 13 are disposed on the front wall 3 of the box so that the end faces 12 of one row of oblong bodies 13 are disposed in the same plane making an angle of 5° with the vertical plane, in order that the light rays striking the first end face 12 be refracted towards the ground.

Each of the three housings 14*a*, 14*b* and 14*c* houses an electroluminescent diode 30 mounted on an electronic circuit 31 associated with each oblong body 13. The electronic circuits 31 are connected together by bundles of wires 32 linked with a member for controlling the message to be displayed.

The major part of the light emitted by a diode 30 illuminates the bottom 18 of the corresponding housing which, thanks to its convex surface, concentrates the light received into a narrow pencil directed towards the first end face 12 which deflects this pencil downwardly.

That part of the light emitted which traverses the cylindrical wall of the corresponding housing is reflected by the surface 21 and possibly the surface 22 before emerging through the first end face 12.

The body 13 therefore acts as a light guide which, in addition, concentrates the light emitted by an electroluminescent diode, into a narrower pencil. The shape of the oblong body 13 and the angles of the surfaces 21 and 22 with respect to direction X are calculated so that the light output of the device is clearly improved. The wall 21 intersects the axis X at an angle of about 21.8° and the wall 22 makes an angle of 8.53° with axis X.

The body 13 operates in accordance with the multiple optical reflection principle and its geometry is designed so that the same effect of light (or one rendered luminous) is obtained from different positions at the inlet. This allows a plurality of light emitting sources to be used simultaneously. In the case of substantially monochromatic sources, the body 13 may serve as a color mixer.

Thanks to simulations, it has been ascertained that, in the case of a body 13 comprising three LEDs placed in the housings 14*a*, 14*b*, 14*c* as described above, the intensity emitted by each diode is virtually identical. The value of the intensity emitted by the diode positioned in the upper housing 14*c* is 2.53 Cd maximum, while that of the intensity emitted for each of the diodes positioned in the lower housings 14*a*, 14*b* is 2.59 Cd maximum. There is a 2.4% difference in intensity emitted between an upper LED and a lower LED.

On the other hand, if the intensity emitted by the same diode is modelized, without the presence of the body 13, by means of the SPEOS software, a value of 1.14 Cd is obtained.

The gain in terms of indicating intensity between a bare LED and a LED disposed in the body 13 as described hereinabove is greater than 2.

What is claimed is:

1. Message display panel of the type comprising a plurality of light emitting elements arranged in matrix form on a display surface, wherein each light emitting element is constituted by a first end face of an oblong body made of a transparent material which comprises on its second end face at least one cylindrical housing in which a light emitting source is placed, said housing presenting a bottom having a convex internal surface so as to concentrate the light flow emitted by said source and illuminating said bottom into a narrower beam directed towards the first end face, said bodies being disposed in rows and columns and separated from one another, wherein the body presents a quadrangular section along a transverse plane, and the body further presents an annular swelling defined on each lateral face of the body by two planar surfaces which intersect in a transverse plane lying between the bottom and the first end face, said surfaces being intended to reflect at least a part of the light rays illuminating the cylindrical wall of a housing towards the first end face.

2. The panel of claim 1, wherein the light emitting source is an electroluminescent diode.

3. The panel of claim 1, wherein the body comprises on its second end face three separate cylindrical housings each receiving a light emitting source.

4. The panel of claim 3, wherein two housings are provided laterally near an edge of the second end face and the third housing is provided near the median zone of the opposite edge.

5. The panel of claim 3, wherein the three light emitting sources emit in different colors.

6. The panel of claim 1, wherein the body presents near its first end face studs for fixing it in an orifice of a support.

7. The panel of claim 1, wherein the first end face of the body is planar and makes an acute angle with the plane perpendicular to axis X of said body.

8. The panel of claim 7, wherein the first end faces of the bodies of the same row are disposed substantially in the same plane parallel to the planes of the first end faces of the bodies of the other rows.

* * * * *